US006469600B1

(12) United States Patent
Seese et al.

(10) Patent No.: US 6,469,600 B1
(45) Date of Patent: Oct. 22, 2002

(54) REMOTE CONTROL CIRCUIT BREAKER WITH A BY-PASS LEAD

(75) Inventors: Daniel Ray Seese, Pittsburgh, PA (US); Wayne Gerald Adamson, Coraopolis, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/916,999

(22) Filed: Jul. 27, 2001

(51) Int. Cl.[7] ..... H01H 75/00
(52) U.S. Cl. ..... 335/6; 335/13; 335/14
(58) Field of Search ..... 335/6, 7, 11, 13, 335/14, 17; 361/115

(56) References Cited

U.S. PATENT DOCUMENTS 5,301,083 A 4/1994 Grass et al.

5,373,411 A * 12/1994 Grass et al. ..... 361/115

* cited by examiner

*Primary Examiner*—Ramon M. Barrera
(74) *Attorney, Agent, or Firm*—Martin J. Moran

(57) ABSTRACT

A remote control circuit breaker which includes a first current path and a second current path. The circuit breaker also includes a set of separable main contacts, an operating mechanism for opening and closing the set of main contacts, a trip device in electrical communication with the main contacts, a set of separable latching contacts having an actuator in electrical communication with the trip device. The circuit breaker also includes a by-pass circuit in electrical communication with the trip device. The first current path passes through the main contacts, the trip device, and the latching contacts and the second current path passes through the main contacts, the trip device, and the by-pass circuit.

11 Claims, 2 Drawing Sheets

REMOTE CONTROL CIRCUIT BREAKER WITH A BY-PASS LEAD

BACKGROUND OF THE INVENTION

1. Field of the Invention

This invention relates to circuit breakers for protecting electric power circuits. More particularly, it relates to circuit breakers with a set of secondary contacts, which are remotely controllable through a latchable operator, such as a magnetically latchable solenoid and which include a by-pass lead that by-passes the latchable operator.

2. Background Information

Circuit breakers provide over-current protection for preventing personal injury and property damage. A loadcenter or panelboard receives electrical power from the utility company transformer and routes the electrical power through a main circuit breaker and then through branch circuit breakers to designated branch circuits, each supplying current to one or more electrical loads. The circuit breakers are designed to interrupt the electrical current if it is excessive or outside the design limits of the conductor and loads, to reduce the risk of injury and damage.

Circuit breakers used in residential and light commercial applications are commonly referred to as miniature circuit breakers because of their limited size. Such circuit breakers typically have a pair of separable contacts opened and closed by a spring biased operating mechanism. A thermal-magnetic trip device actuates the operating mechanism to open the separable contacts in response to persistent over-current conditions and to short circuits. Usually, circuit breakers of this type for multiple circuits within a residence or commercial structure are mounted together within the load center or panel board.

In some applications, it has been found convenient to use the circuit breakers for other purposes than just protection, for instance, for load shedding. It is desirable to be able to perform this function remotely, and even automatically, such as under the control of a computer. However, the spring biased operating mechanisms are designed for manual reclosure and are not easily adapted for reclosing remotely. In any event, such operating mechanisms are not designed for repeated discretionary switching operation over an extended period of time.

As disclosed in U.S. Pat. Nos. 5,301,083 and 5,373,411 which describe remotely operated circuit breakers, miniature circuit breakers have been developed with a second pair of contacts in series with the main separable contacts. The main contacts still interrupt the overcurrent, while the latching contacts perform the discretionary switching operations. The latching contacts are controlled by a solenoid, which is spring biased to close the contacts. The solenoid can be controlled from a remote location.

The disadvantage of such a remote control circuit breaker is that, while the operator may only desire to open the circuit for one device, the entire circuit will be open once the solenoid is activated. Often, it is desirable to have some power supplied to an area controlled by the remote control circuit breaker. For example, a factory uses a remote control miniature circuit breaker to provide electricity to a device having a motor and a computer for diagnostics, e.g., the computer tracks performance of the motor. The miniature circuit breaker is used to turn the motor off and on by actuating the solenoid. If only one circuit is available, the diagnostic computer will be turned off when the motor is turned off, thus limiting the usefulness of the computer. That is, if the motor develops a problem, it must be turned off. Turning off the motor also turns off the computer. Using the prior art circuit breakers, the only configuration that allows the motor to be off and the computer to remain in operation requires the use of two separate circuits. Use of multiple circuits for a single location can be expensive and inconvenient. Additionally, each circuit requires its own breaker to detect a fault.

There is, therefore, a need for a remote control circuit breaker that will open the entire circuit upon a fault, but which has a load terminal that bypasses the circuit operated by the remote control.

There is a further need for such circuit breaker that is compatible with existing load centers and panel boards.

There is a further need for such circuit breaker that is easily manufactured.

SUMMARY OF THE INVENTION

These needs, and others, are satisfied by the invention, which provides a remotely controllable circuit breaker, which includes a latching solenoid to open and close a latching contact terminal and a by-pass terminal. The circuit for the latching contact terminal passes through the main contacts and the latching contact. The circuit for the by-pass wire only passes through the main contacts. The main contacts can be manually opened or opened via the thermal-magnetic trip device. The latching contact is opened by operation of the solenoid.

Thus, the invention provides a circuit breaker having two load terminals or a load terminal and a wire lead terminal. Both terminals are in electrical communication with the main contacts. Therefore, whenever a fault occurs and the main contacts are tripped, or when the main contacts are intentionally opened, both terminals are de-energized. When the main contacts are closed and the latching contact is opened, however, only the latching contact terminal is de-energized.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As used herein, a "remote control circuit breaker" means a circuit breaker having a set of main contacts and a set of secondary or latching contacts. Wherein the latching contacts may be opened and closed from a location outside the circuit breaker.

Figure 1:
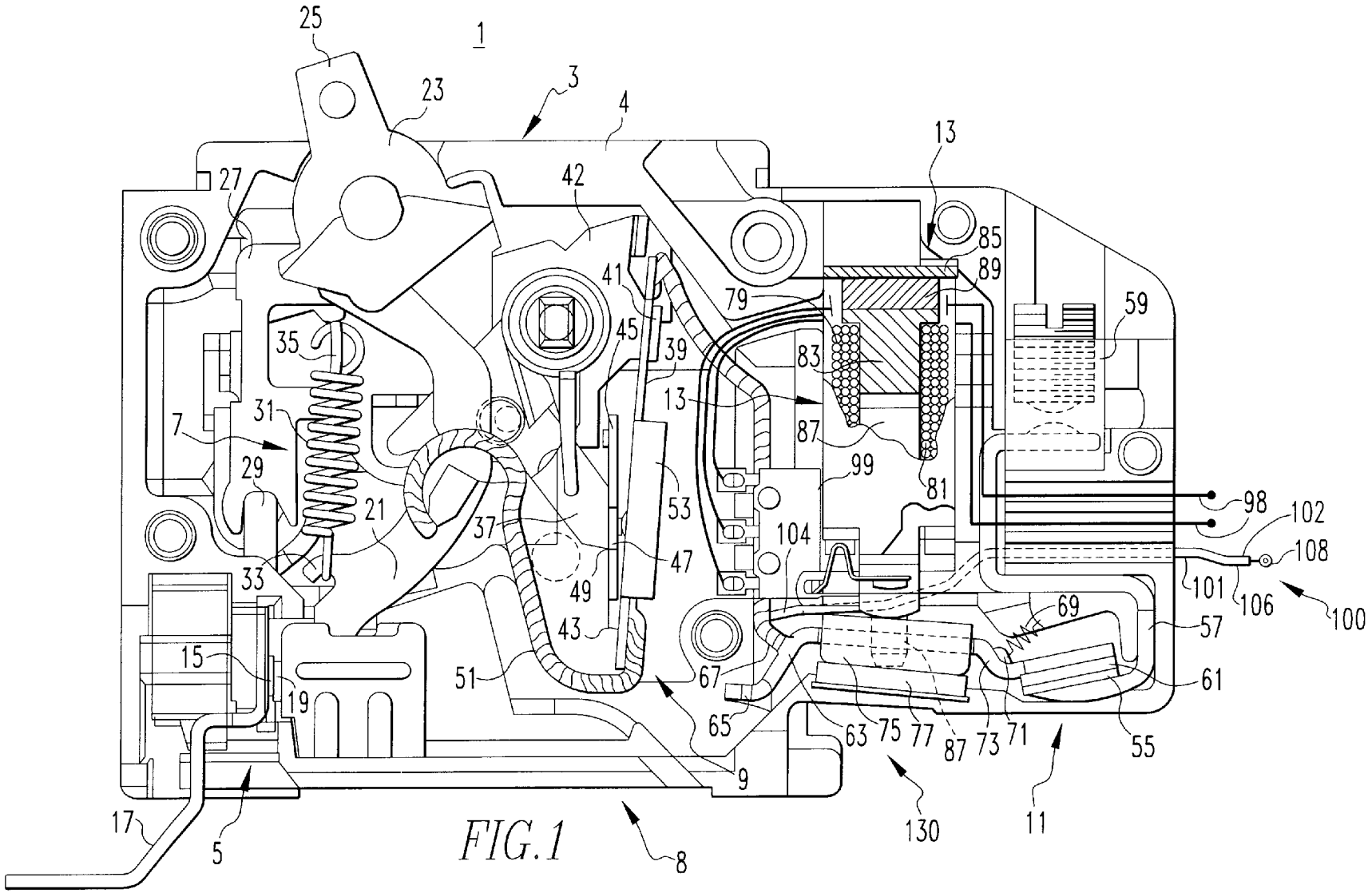
FIG. 1 is an elevational view of a remotely controllable circuit breaker in accordance with the invention shown with the cover removed and with the main contacts and latching contact closed.

The invention will be described as applied to a miniature circuit breaker, although it will become apparent that it could be applied to other types of circuit breakers as well. Such a miniature circuit breaker 1 includes a molded housing 3 and is shown in FIG. 1 with the cover of the housing 3 removed. The basic components of the circuit breaker 1 are a set of main contacts 5, an operating mechanism 7 for opening the set of main contacts 5, and a trip device 8 which actuates the operating mechanism 7 to trip the set of main contacts 5 open in response to certain overcurrent or short circuit conditions. Further included are a set of latching contacts 11 and an actuator in the form of a magnetically latchable solenoid 13 which is remotely controllable to control the open and closed states of the set of latching contacts 11. Further included is a by-pass circuit 100 which includes an insulated wire 102. Two current paths extend through the circuit breaker 1. A first current path passes through the main contacts 5, the trip device 8, and the latching contacts 11. A second current path passes through the main contacts 5, the trip device 8, and the by-pass circuit 100. Preferably, the trip device is a thermal-magnetic trip device 9 as described below.

Figure 2:
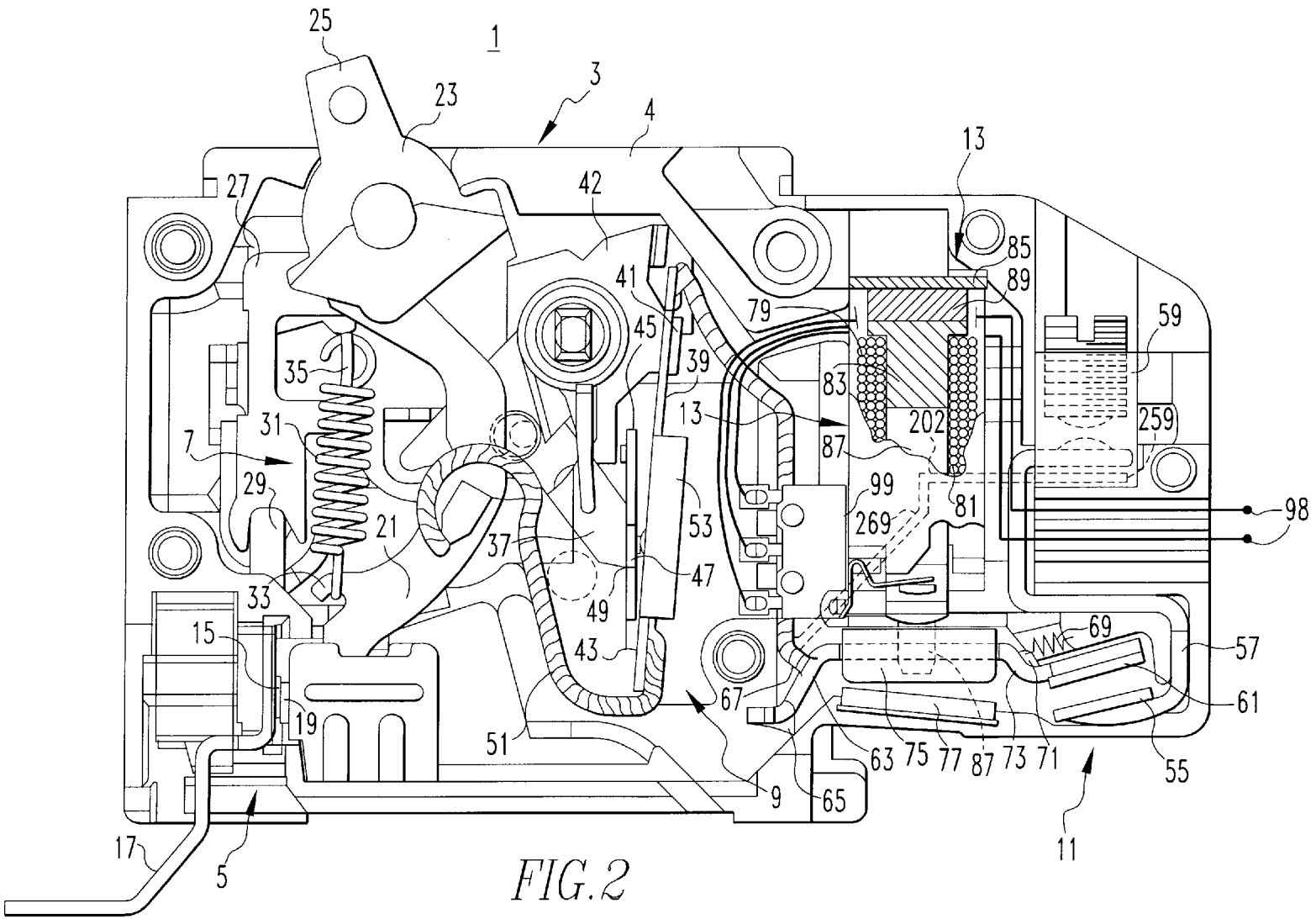
FIG. 2 is an elevational view of an alternate embodiment

The set of main contacts 5 includes a fixed contact 15 secured to a line terminal 17 and a moveable main contact 19 which is affixed to an arcuate contact arm 21 which forms part of the operating mechanism 7. The operating mechanism 7 is a well-known device, which includes a pivotally mounted operator 23 with an integrally molded handle 25. The operating mechanism 7 also includes a cradle 27 pivotally mounted on a support 29 molded in the housing. With the handle 25 in the closed position, as shown in FIGS. 1 and 2, a spring 31 connected to a hook 33 on the contact arm 21 and a tab on the cradle 27 holds the main contacts 5 closed. The spring 31 also applies a force with the set of main contacts 5 closed, as shown, to the cradle 27 which tends to rotate the cradle in a clockwise direction about the support 29. However, the cradle 27 has a finger 37, which is engaged by the thermal-magnetic trip device 9 to prevent this clockwise rotation of the cradle under normal operating conditions.

The thermal-magnetic trip device 9 includes an elongated bimetal 39 which is fixed at its upper end to a tab 41 on the metal frame 42 seated in the molded housing 3. Attached to the lower, free end of the bimetal 39 by a lead spring 43 is an armature 45. The armature 45 has an opening 47, which is engaged by a latching surface 49 on the finger 37.

The free end of the bimetal 39 is connected to the contact arm 21 by a first braided conductor 51 in order that the load current of the circuit protected by the circuit breaker 1 passes through the bimetal. A persistent overcurrent heats the bimetal 39, which causes the lower end thereof to move to the right, with respect to FIGS. 1 and 2. If this overcurrent is of sufficient magnitude and duration, the latching surface 49 on the finger 37 is pulled out of engagement with the armature 45. This allows the cradle 27 to be rotated clockwise by the spring 31. The clockwise rotation of the cradle 27 moves the upper pivot point for the contact arm 21 across the line of force of the spring 31 in order that the contact arm is rotated counterclockwise, to open the set of main contacts 5, as is well understood. This also results in the handle 25 rotating to an intermediate position (not shown) to indicate the tripped condition of the set of main contacts 5.

In addition to the armature 45, a magnetic pole piece 53 is supported by the bimetal 39. Very high overcurrents, such as those associated with a short circuit, produce a magnetic field which draws the armature 45 to the pole piece 53, thereby also releasing the cradle 27 and tripping the set of main contacts 5 open. Following either trip, the main set of contacts 5 are reclosed by moving the handle 25 fully clockwise, which rotates the cradle 27 counterclockwise until the finger 37 relatches in the opening 47 in the armature 45. Upon release of the handle 25, it moves counterclockwise slightly from the full clockwise position and remains there. With the cradle relatched, the line of force of the spring 31 is reestablished to rotate the contact arm 21 clockwise to close the set of main contacts 5 when the handle 25 is rotated fully counterclockwise to the position shown in FIGS. 1 and 2.

The set of latching contacts 11 includes a fixed secondary contact 55 which is secured on a load conductor 57 that leads to a load terminal 59. The set of latching contacts 11 also includes a moveable secondary contact 61 which is fixed to a secondary contact arm 63 that at its opposite end is seated in a molded pocket 65 in the molded housing 3. The secondary contact arm 63 is electrically connected in series with the set of main contacts 5 by a second flexible braided conductor 67 connected to the fixed end of the bimetal 39. Thus, a circuit or load current is established from the line terminal 17 through the set of main contacts 5, the contact arm 21, the first flexible braided conductor 51, the bimetal 39, the second flexible braided conductor 67, the secondary contact arm 63, the set of latching contacts 11, and the load conductor 57 to the load terminal 59.

The set of latching contacts 11 is biased to the closed state shown in FIG. 1 by a helical compression spring 69 seated on a projection 71 on an offset 73 in the secondary contact arm 63. As discussed in U.S. Pat. No. 5,301,083, the spring 69 is oriented such that the force that it applies to the secondary contact arm 63 tending to close the set of latching contacts is relaxed to a degree with the set of latching contacts 11 in the open position of FIG. 2. This serves the dual purpose of providing the force needed to close the set of latching contacts 11 against rated current in the protected circuit and also reducing the force that must be generated by the magnetically latching solenoid 13 to hold the set of latching contacts in the open state. In order for the set of latching contacts 11 to withstand short circuit currents and allow the set of main contacts 5 to perform the interruption, the magnet force generated by the short circuit current causes an armature 75 mounted on the secondary contact arm 63 to be attracted to a pole piece 77 seated in the molded housing 3 thereby clamping the latching contacts closed.

The actuator/solenoid 13 includes an open/close coil 79 wound on a steel core 83 supported by a steel frame 85. A plunger 87 moves rectilinearly within the single coil 79. A permanent magnet 89 is seated between the steel core 83 and the steel frame 85. To operate the coil 79, when the plunger 87 is not seated against the core 83 and a magnetic field is induced by applying a suitable voltage to the windings of the coil 79, the core 83 and the plunger 87 then attract magnetically, pulling the plunger 87 against the core 83. The magnet 89 then holds the plunger 87 against the core 83 without an induced electrical field. To release the plunger 87 from the core 83, an opposite flux field is induced in the coil windings by applying an opposite polarity voltage thereto. When the opposite field is applied, the magnetic field from the permanent magnet 89 is zeroed out or decreased to the point where a light axial load is capable of pulling the plunger 87 away from the core 83.

The plunger 87 engages the secondary contact arm 63. When the open/close coil 79 is energized with a close polarity signal (e.g., a negative voltage in the exemplary embodiment), a magnetic field is produced which drives the plunger 87 downward to a first position which rotates the secondary contact arm 63 clockwise and thereby moves the set of latching contacts 11 to the closed state. The latching contacts 11 are maintained in the closed state by the spring 69 as shown in FIG. 1.

When it is desired to open the set of latching contacts 11, the open/close coil 79 is energized with an open polarity signal (e.g., a positive voltage in the exemplary embodiment), which lifts the plunger 87 and with it the secondary contact arm 63 to a second position which opens the set of latching contacts 11. With the plunger 87 in the full upward position as shown in FIG. 2, it contacts the steel core 83 and is retained in this second position by the permanent magnet 89. Subsequently, when the open/close coil 79 is again energized with the close polarity signal, the magnetic field generated is stronger than the field generated by the permanent magnet 89 and, therefore, overrides the latter and moves the plunger 87 back to the first, or closed position. The open/close coil 79 of the magnetically latching solenoid 13 is remotely controlled by an external switch or remote control circuit (not shown) having input leads 98. This remote control circuit interfaces with an internal switch or power cutoff device in the form of microswitch 99. The remote control circuit acts as a means structured for energizing the coil 79 with a first polarity signal or, alternatively, a second polarity signal.

A by-pass circuit 100 is structured to by-pass the set of latching contacts 11. The by-pass circuit 100 includes a conductor 101, such as an insulated wire 102 having a first end 104 and a second end 106. The conductor first end 104 is coupled to the second braided conductor 67 at a point somewhere between bimetal 39 and the secondary contact arm 63. The conductor second end 106, preferably, extends beyond the housing 3 at a location near input leads 98. The conductor second end 106 may include a terminal 108 or similar coupling device.

In this configuration, the by-pass circuit 100 is connected in series with the set of main contacts 5 and the thermal-magnetic trip device 9. Thus, so long as the main contacts 5 are closed, electricity flows through the by-pass circuit 100. Because the thermal-magnetic trip device 9 is disposed between the main contacts 5 and the by-pass circuit 100, an over-current condition in the by-pass circuit will cause the thermal-magnetic trip device 9 to actuate the operating mechanism 7 and open the main contacts 5. The latching contacts 11, however, are not part of the by-pass circuit 100. As such, the latching contacts 11 may be open or closed without affecting the by-pass circuit 100.

Alternatively, as shown on FIG. 2, the conductor 101 may be a bus bar 202 which forms a by-pass load terminal 259. Such a by-pass load terminal 259 is disposed within a cavity in the housing 3, preferably adjacent to load terminal 59. The bus bar 202 is connected to the second braided conductor 67 by a by-pass braided conductor 269.

While specific embodiments of the invention have been described in detail, it will be appreciated by those skilled in the art that various modifications and alternatives to those details could be developed in light of the overall teachings of the disclosure. For example, the trip device 8 may be a magnetic trip device having a solenoid providing an instantaneous trip or an electronic trip circuit. In any case, the current drawn by each load terminal is detected by the trip device. Accordingly, the particular arrangements disclosed are meant to be illustrative only and not limiting as to the scope of invention which is to be given the full breadth of the claims appended and any and all equivalents thereof.

What is claimed is:

1. A remote control circuit breaker comprising:

an insulated housing;

a first current path extending through said housing;

a second current path extending through said housing;

a set of separable main contacts;

an operating mechanism for opening and closing said set of main contacts;

a trip device;

said trip device in electrical communication with said main contacts;

a set of separable latching contacts having an actuating means;

said separable latching contacts in electrical communication with said trip device;

a by-pass circuit;

said by-pass circuit in electrical communication with said trip device; and whereby said first current path passes through said main contacts, said trip device, and said latching contacts and said second current path passes through said main contacts, said trip device, and said by-pass circuit.

2. The remote control circuit breaker of claim 1, wherein said latching contact actuating means comprises:

a latching solenoid including a plunger latchable to a first position which opens said set of latching contacts and to a second position which closes said set of latching contacts, a coil which when energized with a first polarity signal operates said plunger to said first position and which when energized with an opposite second polarity signal operates said plunger to said second position; and means structured for cooperation with said coil providing the first polarity signal or, alternatively, the second polarity signal.

3. The remote control circuit breaker of claim 1, wherein said trip device is a thermal-magnetic trip device.

4. The remote control circuit breaker of claim 1, wherein said by-pass circuit comprises:

a conductor having a first end and a second end; and said first end in electrical communication with said trip device.

5. The remote control circuit breaker of claim 4, wherein said by-pass conductor is an insulated wire.

6. The remote control circuit breaker of claim 5, wherein said insulated wire second end extends beyond said housing.

7. The remote control circuit breaker of claim 4, wherein said insulated wire second end includes a terminal.

8. The remote control circuit breaker of claim 4, wherein:

said first current path and said second current path include a braided conductor disposed between, and in electrical communication with, said trip device and said separable latching contacts; and said braided conductor in electrical communication with said separable latching contacts and with said by-pass circuit conductor.

9. The remote control circuit breaker of claim 3, wherein said by-pass conductor is a bus bar.

10. The remote control circuit breaker of claim 6, wherein said by-pass conductor bus bar forms a load terminal.

11. The remote control circuit breaker of claim 10, wherein said by-pass circuit includes a by-pass braided conductor disposed between said bus bar terminal and said braided conductor.

* * * * *